US007850339B2

(12) United States Patent
Wadia et al.

(10) Patent No.: US 7,850,339 B2
(45) Date of Patent: Dec. 14, 2010

(54) DISPLAY HAVING THIN CROSS-SECTION AND/OR MULTI-COLORED OUTPUT

(75) Inventors: Bahar N. Wadia, Bartlett, IL (US); Donald Charles Mueller, Aurora, IL (US)

(73) Assignee: Touchsensor Technologies, LLC, Wheaton, IL (US)

( * ) Notice: Subject to any disclaimer, the term of this patent is extended or adjusted under 35 U.S.C. 154(b) by 271 days.

(21) Appl. No.: 11/705,232

(22) Filed: Feb. 12, 2007

(65) Prior Publication Data

US 2007/0285917 A1 Dec. 13, 2007

Related U.S. Application Data

(63) Continuation-in-part of application No. 10/764,170, filed on Jan. 22, 2004, now Pat. No. 7,175,304.

(60) Provisional application No. 60/443,651, filed on Jan. 30, 2003, provisional application No. 60/797,552, filed on May 4, 2006.

(51) Int. Cl.
*F21V 7/04* (2006.01)

(52) U.S. Cl. ..... 362/241; 362/560; 362/249.02

(58) Field of Classification Search ..... 362/27, 362/92, 30, 555, 558–561, 23, 26, 28, 249.02, 362/230, 231, 243–247
See application file for complete search history.

(56) References Cited

U.S. PATENT DOCUMENTS

| | | | | |
|---|---|---|---|---|
| 4,058,919 | A | 11/1977 | Wakabayashi | |
| 4,254,453 | A | 3/1981 | Mouyard et al. | |
| 4,345,308 | A | 8/1982 | Mouyard et al. | |
| 4,734,619 | A | 3/1988 | Havel | |
| 5,226,723 | A * | 7/1993 | Chen | 362/241 |
| 5,594,222 | A | 1/1997 | Caldwell | |
| 6,310,611 | B1 | 10/2001 | Caldwell | |
| 6,320,282 | B1 | 11/2001 | Caldwell | |
| 6,345,903 | B1 | 2/2002 | Koike et al. | |

(Continued)

FOREIGN PATENT DOCUMENTS

| | | |
|---|---|---|
| CA | 1259143 | 9/1989 |

(Continued)

OTHER PUBLICATIONS

PCT International Search report and Written Opinion of the International Searching Authority (Forms PCT/ISA/210 and PCT/ISA/237).

(Continued)

*Primary Examiner*—Bao Q Truong
(74) *Attorney, Agent, or Firm*—Barnes & Thornburg LLP

(57) ABSTRACT

A display includes a substrate having front and rear sides and defining one or more optical paths. A light source corresponding to each optical path is associated with the rear side of the substrate. Light propagates from the light source to the front side of the substrate through the corresponding optical path. Offsetting the light source from the centerline of the optical path improves light diffusion by promoting light reflection off the sides of the optical path. Multiple light sources of different colors can be associated with each optical path to provide for variable color output from each optical path at the front side of the substrate.

24 Claims, 7 Drawing Sheets

U.S. PATENT DOCUMENTS

| | | | | |
|---|---|---|---|---|
| 6,598,988 | B1 | 7/2003 | Noll et al. | |
| 6,652,128 | B2 * | 11/2003 | Misaras | 362/488 |
| 6,809,470 | B2 | 10/2004 | Morley et al. | |
| 7,063,430 | B2 * | 6/2006 | Greiner | 362/30 |
| 7,312,927 | B2 * | 12/2007 | Bogner et al. | 359/630 |

FOREIGN PATENT DOCUMENTS

| | | | |
|---|---|---|---|
| DE | 10 99 403 | B | 2/1961 |
| DE | 1099403 | | 2/1961 |
| EP | 0884786 | A | 12/1998 |
| FR | 2 651 356 | A | 3/1991 |
| GB | 1 585 392 | A | 3/1981 |
| JP | 62-41183 | U | 3/1987 |
| JP | 06-034505 | A | 2/1994 |
| JP | 06-301342 | A | 10/1994 |
| JP | 07-036388 | A | 2/1995 |
| JP | 07-281617 | A | 10/1995 |
| JP | 08-014684 | A | 1/1996 |
| JP | 10-260644 | A | 9/1998 |
| JP | 2000-155536 | A | 6/2000 |
| JP | 2000-284726 | A | 10/2000 |
| JP | 2001-085748 | A | 3/2001 |
| JP | 2003-045643 | A | 2/2003 |
| WO | 01/38120 | | 5/2001 |
| WO | WO 2004/068448 | | 8/2004 |
| WO | WO 2005/046057 | | 5/2005 |
| WO | WO 2006/133180 | | 12/2006 |

OTHER PUBLICATIONS

English translation of Office Action issued in related patent application No. JP2006-503141 (2010).

Office Action issued Apr. 6, 2010, in related patent application No. CA 2,514,463 (2010).

Office Action issued Jun. 8, 2007, in related patent application No. EP 04706481.1 (2007).

Office Action issued Jan. 31, 2007, in related patent application No. IN1582/KOLNP/2005 (2007).

Office Action issued Jan. 14, 2008, in related patent application No. IN1582/KOLNP/2005 (2008).

Office Action issued Dec. 16, 2009, in related patent appl. No. EP07761267.9 (2009).

* cited by examiner

DISPLAY HAVING THIN CROSS-SECTION AND/OR MULTI-COLORED OUTPUT

CROSS REFERENCE TO RELATED APPLICATIONS

This application claims priority from and is filed as a continuation-in-part of U.S. patent application Ser. No. 10/764,170, filed on Jan. 22, 2004, now U.S. Pat. No. 7,175,304 which claims priority from U.S. Provisional Patent Application No. 60/443,651, filed on Jan. 30, 2003. This application also claims priority from U.S. Provisional Patent Application No. 60/797,552, filed on May 4, 2006. This application incorporates by reference the disclosures of each of the foregoing applications.

BACKGROUND OF THE INVENTION

1. The Technical Field

The present invention relates generally to displays used in man/machine interfaces. More particularly, the present invention relates to displays integration of such displays into equipment panels and other substrates, displays having thin cross sections, and displays having multi-colored output.

2. The Prior Art

Displays are used to visually communicate information to users of machines as diverse as coffee makers and industrial presses. Such displays can be embodied in many forms. For example, a simple display might take the form of one or more lights that illuminate selectively to indicate the status of a machine (e.g., energized, running, stopped). A more complex display might include one or more multi-segment or dot matrix elements for providing alphanumeric information (e.g., temperature, pressure, time). A conventional display typically is provided as a pre-manufactured component or sub-assembly for later mounting to a carrier or substrate, for example, a printed wiring board or other component or panel of a machine. Such substrate or carrier may include other include other electrical/electronic components, for example, proximity sensors.

Conventional displays have numerous shortcomings. For example, they can be complicated and expensive to build. Indeed, some applications might even require custom-made displays. This can make them unsuitable for low-cost applications.

Also, conventional displays often are too thick for integration into applications requiring a low profile. Conventional displays typically comprise a substrate having a viewable surface and a rear surface. The substrate typically defines an aperture or other form of light guide for each element or segment of the display. A light source typically is surface-mounted to the rear surface of the substrate such that the light source is aligned with the aperture. When the light source is energized, light is transmitted through the aperture, which then appears as an illuminated area on the viewable surface of the substrate. In a well-designed display, each such illuminated area should be illuminated evenly. Otherwise, the display will be unattractive and difficult to read.

In order to ensure even illumination at the viewable surface, the viewable surface typically is separated from the light source by a distance sufficient to allow light emanating from the light source to fully diffuse before it reaches the viewable surface. The amount of separation required in a particular application is a function of the illuminable surface area of the display segment (e.g., aperture) and the type of light source employed, among other factors, as would be recognized by one skilled in the art. For example, the required separation generally increases as a function of illuminable surface area. Also, use of a point source, for example, a light emitting diode (LED), as the light source generally dictates greater separation than use of a light source that generates relatively diffuse light. In embodiments wherein the light source is aligned with the aperture, the required separation typically is achieved by using a substrate of a certain minimum thickness and/or by locating the light source rearward of the rear surface of the substrate. It should be apparent that this approach dictates a certain minimum overall display thickness, particularly when the display is to be post-attached to another substrate, for example, an equipment panel.

Further, the output color of a conventional display typically is determined by the color of the light source used. As such, the output color of a conventional display typically is determined at the time of manufacture and is not readily user-configurable.

SUMMARY OF THE INVENTION

The present invention provides a display that can be integrated into a component carrier or substrate, for example, a printed wiring board or panel of an apparatus in connection with which the display is to be used, thus obviating the need for a separate display component. Other components, such as sensors, can be integrated into the assembly, as well. Without limitation, sensors as described in U.S. Pat. No. 5,594,222, No. 6,310,611 and No. 6,320,282, the teachings of which are incorporated herein by reference, are well suited for such an application.

In a preferred embodiment, the substrate is of substantially uniform thickness and relatively thin compared to its length and width. However, the substrate may embody any other shape and cross section, as well. Thus, the first and second surfaces may be, but need not be, substantially parallel. The substrate typically would be embodied as a printed wiring board, but could be embodied in any other number of other forms. For example, the substrate could be an exterior panel of an appliance or the dash panel of an automobile.

In a preferred embodiment, the substrate defines one or more penetrations therethrough, each such penetration having a side wall, an entrance opening and an exit opening. The penetration can be of any regular or irregular shape, for example, round, square or elliptical, and it can be formed using any suitable molding, forming or machining technique, for example, NC drilling or punching, among others. A light source is associated with the entrance opening and is configured to selectively direct or otherwise admit light to the penetration through the entrance opening. Preferred light sources include lamps, LEDs, OLEDs, PLEDs, though others can be used, as well.

The penetration serves as a light guide. To this end, the side wall of the penetration preferably is coated with a reflective material, for example, white paint or a reflective metal, so that light introduced to the penetration is transmitted therethrough and not dissipated into the substrate. In other embodiments, the side wall could be coated with any substantially opaque material which precludes diffusion of light into the substrate. Further, the side wall could be left uncoated if the substrate were made of a material that does not substantially transmit light. In the foregoing embodiments, light entering the penetration at the entrance opening propagates through the penetration and exits the penetration at the exit opening, either directly, or by reflecting off of the penetration's side wall(s).

In alternate embodiments, the penetration can serve as a housing for a light guide. In such embodiments, the penetration can be substantially filled with a material having a high refractive index, for example, a light transmissive epoxy having good optical properties. Light entering the refractive material from the entrance opening reflects off the internal walls of the refractive material and exits the refractive material at the exit opening. Thus, the refractive material acts as a light guide. In further alternate embodiments, a discrete light guide could be installed in the penetration.

In a preferred embodiment, a light diffuser is associated with the exit opening of the penetration. The diffuser diffuses light exiting the penetration to enhance readability of the display by the user. Such light diffuser typically would be embodied as a layer of light transmissive material applied over the exit opening.

In an alternate embodiment, the substrate defines one or more cavities, instead of (or in addition to) the foregoing penetrations. Each cavity includes a side wall and an entrance opening. Such cavities do not completely penetrate the substrate. Thus, each cavity includes a closed end instead of an exit opening. These cavities can be molded into the substrate or formed into the substrate using any suitable machining technique. In this embodiment, at least the portion of the substrate between the closed end of the cavity and the second surface of the substrate is transparent or translucent so that light may be transmitted therethrough. The side wall of the cavity preferably is coated in the manner discussed above to preclude light dispersion into the substrate. Alternatively, the cavity can be filled with a refractive material, as discussed above. In this embodiment, the portion of the substrate between the closed end of the cavity and the second surface of the substrate performs the function of the light diffuser of the embodiment described above.

A display according to the present invention can mimic conventional single element or multiple element displays. Typically, a single penetration or cavity would be used to mimic a single element display, such as a status indicator light, or the individual elements of a multiple element display. For example, seven penetrations or cavities arranged in the manner of a conventional seven-segment display could mimic such a conventional display. Other configurations are possible, as well. Further, any practical number of displays can be located on the same substrate. Thus, the present invention is well-suited to applications requiring multiple displays.

The substrate can include other components commonly present in man/machine interfaces, such as sensors and other electrical or electronic components. Integration of such components with the display can further reduce the cost, complexity, and size of an end component. The substrate also can include decoration, texture, and the like, for functional or purely decorative purposes.

In another preferred embodiment, the present invention laterally offsets the light source from the centerline of the penetration or light guide so as increase the separation between the light source and the viewable surface of the display for any given thickness of substrate and to enhance diffusion of the light between the light source and the viewable surface. Preferably, the light source is offset entirely from its corresponding penetration.

In yet another preferred embodiment, the present invention includes multiple light sources of different colors in connection with each segment of a display. These light sources can be energized individually or in combination, such that the color output of the display is readily reconfigurable, as would be recognized by one skilled in the art.

DETAILED DESCRIPTION OF THE ILLUSTRATED EMBODIMENTS

Figure 1A:
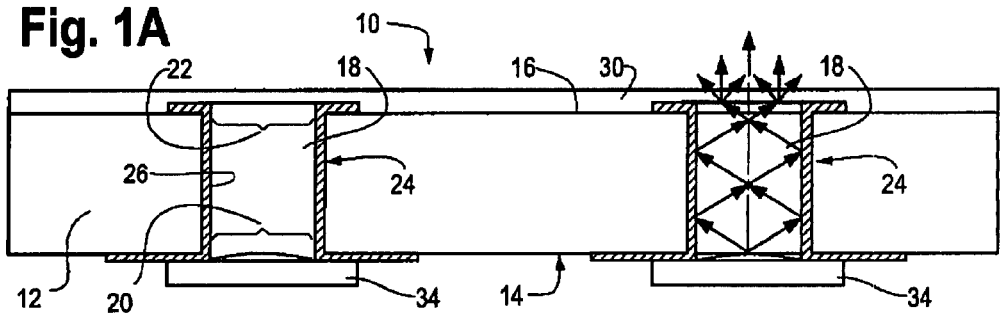
FIG. 1A is a cross-sectional view of an embodiment of the present invention.
Figure 1B:
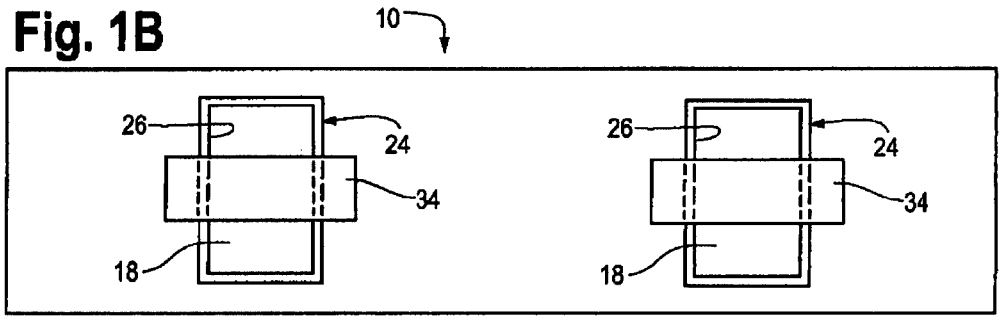
FIG. 1B is a top plan view of the apparatus illustrated in FIG. 1A.

FIGS. 1A and 1B illustrate a preferred embodiment of an integrated display 10 according to the present invention. Display 10 includes a substrate 12 having a first surface 14 and a second surface 16. Substrate 12 can be embodied as virtually any type of substrate, carrier, panel, etc. Although illustrated as planar and having uniform thickness, substrate 12 can take any virtually any other form. For example, it can have regularly or irregularly varying non-uniform thickness. It can be curved, rippled, or have any variety of complex shapes and cross-sections. In a typical embodiment, substrate 12 might be a printed wiring board, such as an FR4 board with a one-half ounce copper layer and an OSP or HASL finish. In other embodiments, substrate 12 could be an exterior panel of a domestic appliance, such as a coffee maker or washing machine, a dash panel or other interior panel of an automobile, or a panel of any other machine or piece of equipment. These are but a few examples of substrates into which a display can be integrated according to the present invention. Further, although first surface 14 and second surface 16 are illustrated as generally opposed, parallel surfaces, first and second surfaces 14 and 16 could be related in any number of other ways. For example, first and second surfaces 14 and 16 could be at right angles to each other.

Substrate 12, as illustrated in FIG. 1B, includes two rectangular penetrations 18. In other embodiments, substrate 12 may include more or fewer than two such penetrations, and such penetrations may be of any regular or irregular shape, including, without limitation, circular, square, elliptical or free form. Penetrations 18 may be formed by drilling, molding, punching, or other suitable techniques. Each penetration 18 includes an entrance opening 20, an exit opening 22 and a side wall 24.

Penetrations 18 function as light guides or housings for light guides. Light is coupled from a light source into entrance opening 20. The light reflects off of the internal walls of the light guides so that the light ultimately leaves the light guide at the exit opening.

In a preferred embodiment, as illustrated in FIG. 1A, penetrations 18 function as light guides. In order to best enable penetration 18 to function as a light guide, side wall 24 preferably is impervious to light transmission to prevent light dissipation or diffusion through substrate 12. To this end, side wall 24 preferably is plated with a reflective coating 26, as shown in FIG. 1A. In alternate embodiments, side wall 24 can be coated with, for example, white paint or other non-transparent materials. Conceivably, side wall 24 could be left uncoated. In such an embodiment, substrate 12 preferably would be made of a material which inherently reflects light or does not substantially transmit light because such materials would tend to reduce light dissipation through the substrate.

Figure 2:
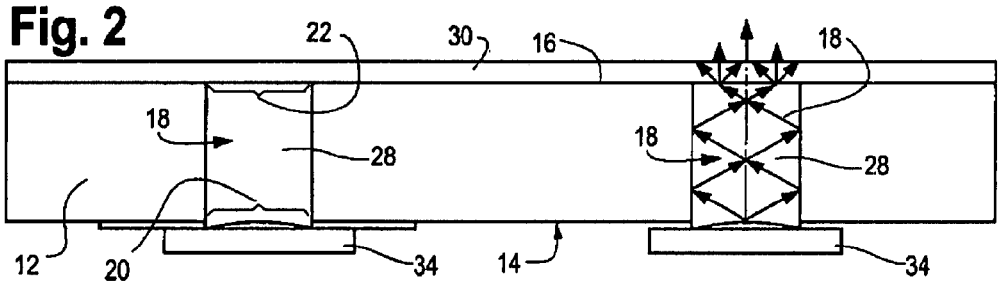
FIG. 2 is a cross-sectional view of an alternate embodiment of the present invention.

In an alternate embodiment, as illustrated in FIG. 2, penetrations 18 function as housings for light guides. In this embodiment, penetrations 18 are filled with an epoxy material 28 having a high refractive index, with the epoxy material comprising the light guide. Such material allows light transmission though penetrations 18, from the first side to the second side of substrate 12, but prevents or retards light dispersion into substrate 12. Other materials having desirable optical, mechanical and electrical properties can be used in lieu of epoxy 28. In another embodiment, not shown in the drawings, a discrete light guide, such as a light pipe could be installed in penetration 18. In the foregoing embodiments, side wall 24 can be, but need not be coated as described above in connection with the FIG. 1A embodiment. A separate light pipe assembly with apertures built into it could serve as the light guide in a similar fashion.

A display according to the present invention can include a diffuser 30 located at or near exit opening 22. The purpose of diffuser 30 is to diffuse light exiting penetration 18 which might otherwise be channelized, thus enhancing readability of the display by the user. To this end, diffuser 30 can be made of any variety of light transmissive materials. In preferred embodiments, diffuser 30 can cover a substantial portion of second surface 16, as shown in FIGS. 1A and 2, or it can simply cover a smaller portion of second surface 16 proximate exit opening 22. Diffuser 30 can include printing or other decoration (not shown) to enhance the functionality of the display (and of any other components associated with the substrate), or for purely decorative purposes. Diffuser 30 can be embodied as, for example, a fascia, an overlay, a piece of glass, or any other structure that aids in diffusing light exiting penetration 18. Display 10 further includes a light source 34 adapted to introduce light to entrance opening 20, as shown in FIGS. 1A, 1B and 2. Preferably, light source 34 takes the form of a low profile LED mounted to first surface 14 of substrate 12, proximate entrance opening 20. In other embodiments, light source 34 could be a lamp, an EL, OLED, PLED, vacuum fluorescent or light source. Although light source LED is illustrated in a particular orientation with respect to penetration 18, other orientations are possible, as well.

Figure 3:
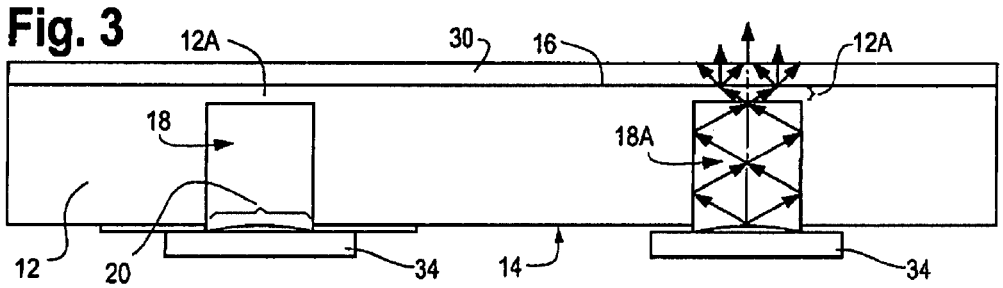
FIG. 3 is a cross-sectional view of another alternate embodiment of the present invention.

In another embodiment illustrated in FIG. 3, substrate 12 defines one or more cavities 18A in lieu of (or in addition to) penetrations 18. Cavities 18A are similar to and provide essentially the same function as penetrations 18, except that cavities 18A do not completely penetrate substrate 12. Instead, a thin layer of substrate material 12A remains where exit opening 22 is located in the FIGS. 1A and 2 embodiments. Thus, each cavity 18A includes an entrance opening 20, a side wall 24 and a closed end 32. Side wall 24 of cavity 18A can be coated with a reflective or other non-transparent material (not shown), as discussed above, so that cavity 18A can function as a light guide. Alternatively, cavity 18A can be filled with a refractive material (not shown), as discussed above, which can function as a light guide. In such embodiments, at least thin layer of substrate material 12A is transparent or translucent so that light may be transmitted therethrough and be visible to the user. Thus, thin layer of substrate material 12A can function as a diffuser, obviating any need for a separate diffuser, such as diffuser 30 as illustrated in FIGS. 1A and 2 and described above. Notwithstanding, a separate diffuser 30 may be layered or screen-printed on surface 16.

Figure 4:
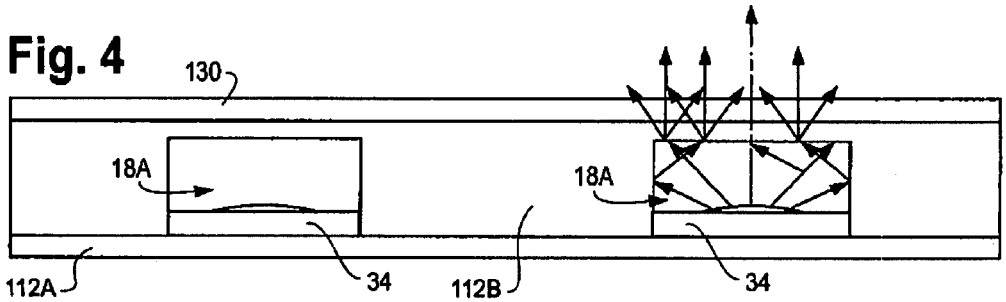
FIG. 4 is a cross-sectional view of a further embodiment of the present invention.

In another alternate embodiment, illustrated in FIG. 4, the light source is disposed on a carrier, for example, a printed wiring board, separate from the substrate comprising the light guide. Here, light sources 34, for example, surface mount LEDs, are disposed on carrier 112A, which can include other components, such as sensors, as discussed above. Substrate 112B includes cavities 18A, as discussed above. In other embodiments, substrate 112B could include penetrations in addition to or in lieu of cavities 18A. Carrier 112A is attached to substrate 112B using adhesives or other suitable attachment means such that light sources 34 mounted on carrier 34 are substantially aligned with cavities 18A (and/or penetrations) in substrate 112B. An optional diffuser 130 can be attached to the viewed surface (here, the opposing surface) of substrate 112B, as described above.

In practice, a seven-segment display could be constructed by tooling (such as by punching or NC drilling) or molding a substrate (such as a printed wiring board) with penetrations corresponding to the seven segments, plating the side walls of the penetrations using known plating techniques, and attaching a suitable light source (such as a surface-mount LED of appropriate color) proximate the entrance opening of each penetration using a suitable technique (such as a reflow-solder technique, using known surface-mount component process equipment), opposite the exit opening and any diffuser or fascia that might be located proximate the exit opening. Other user interface components (such as sensors or other components) could be mounted to the substrate at the same time or as a step during the same production process, thus reducing overall manufacturing cost and yielding an interface of smaller size than could be manufactured using conventional discrete components. In another embodiment, the penetrations could be filled with a material, such as an epoxy, having an appropriate refractive index, in lieu of plating. In further embodiments, the substrate could be could be tooled or molded with cavities instead of penetrations, and the penetrations could be filled with a refractive material or the side walls thereof could be plated.

Figure 5:
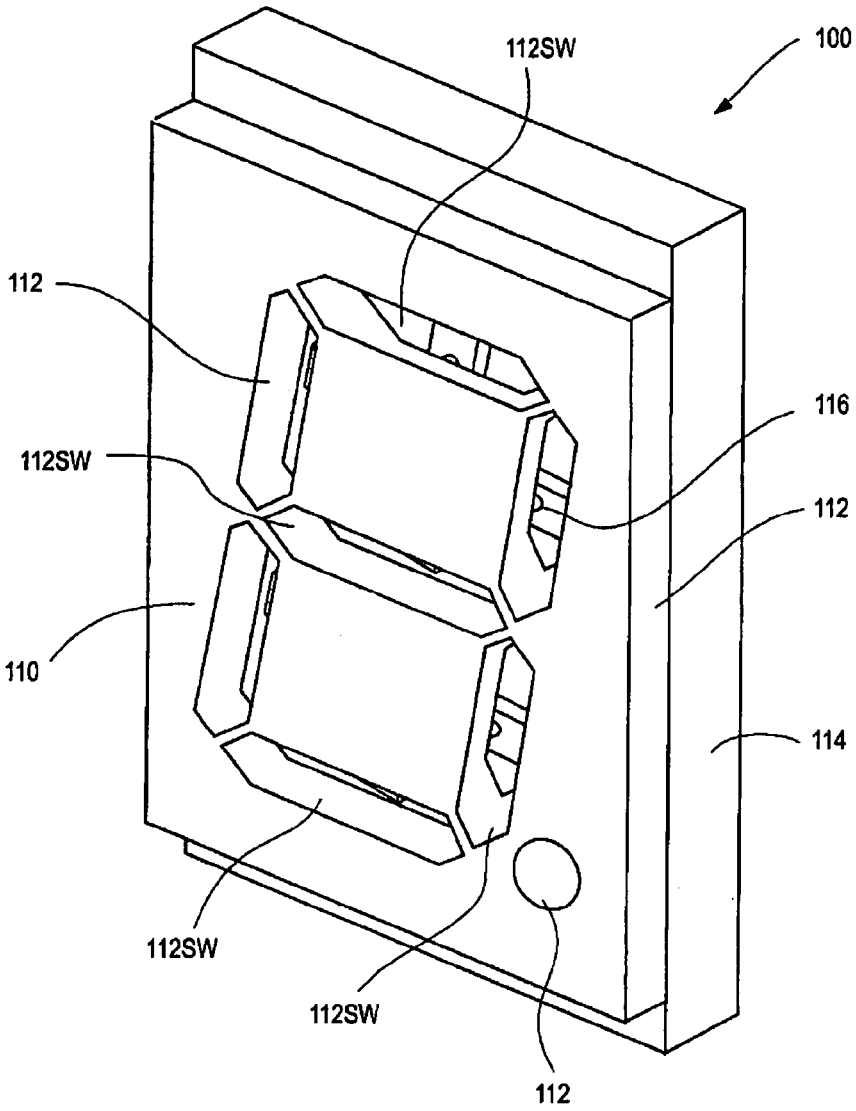
FIG. 5 is a perspective view of yet another embodiment of the present invention.
Figure 6:
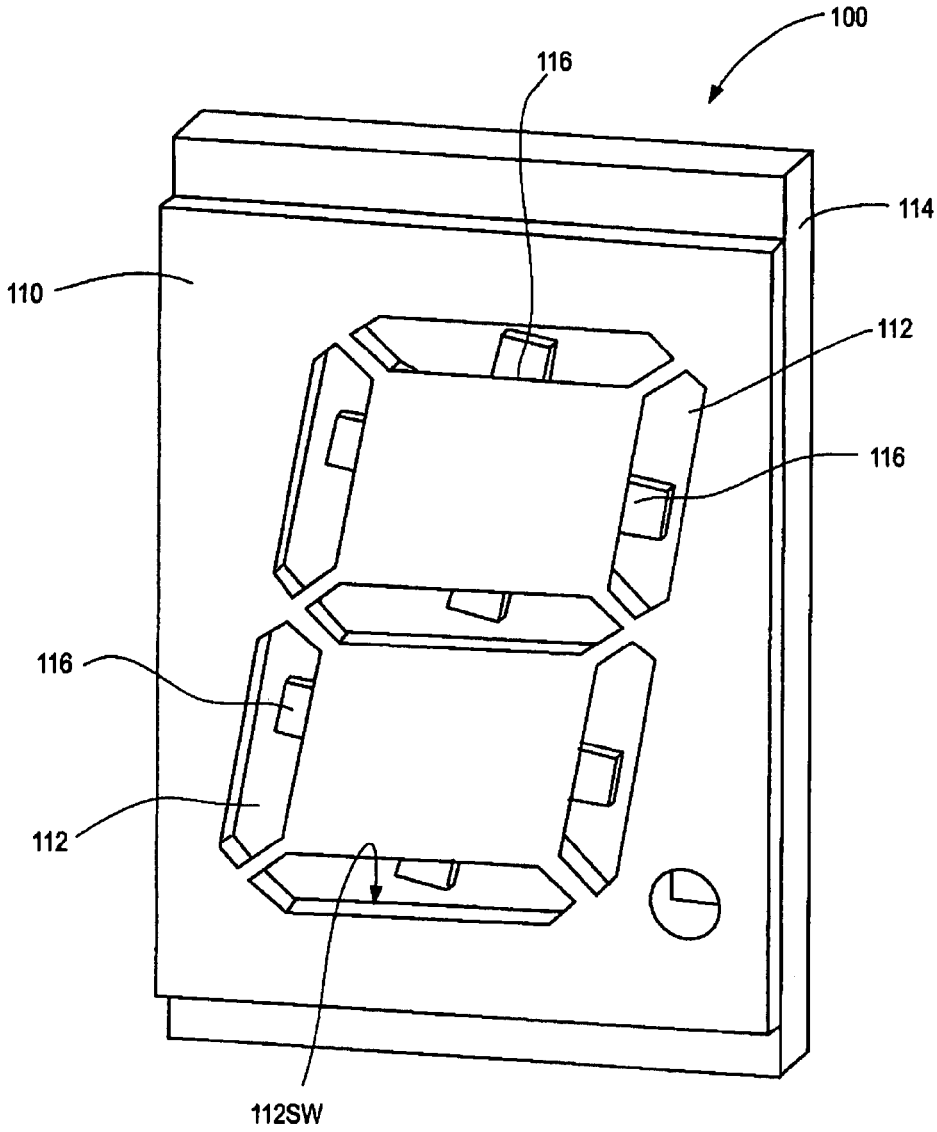
FIG. 6 is another perspective view of the embodiment shown in FIG. 5.
Figure 7:
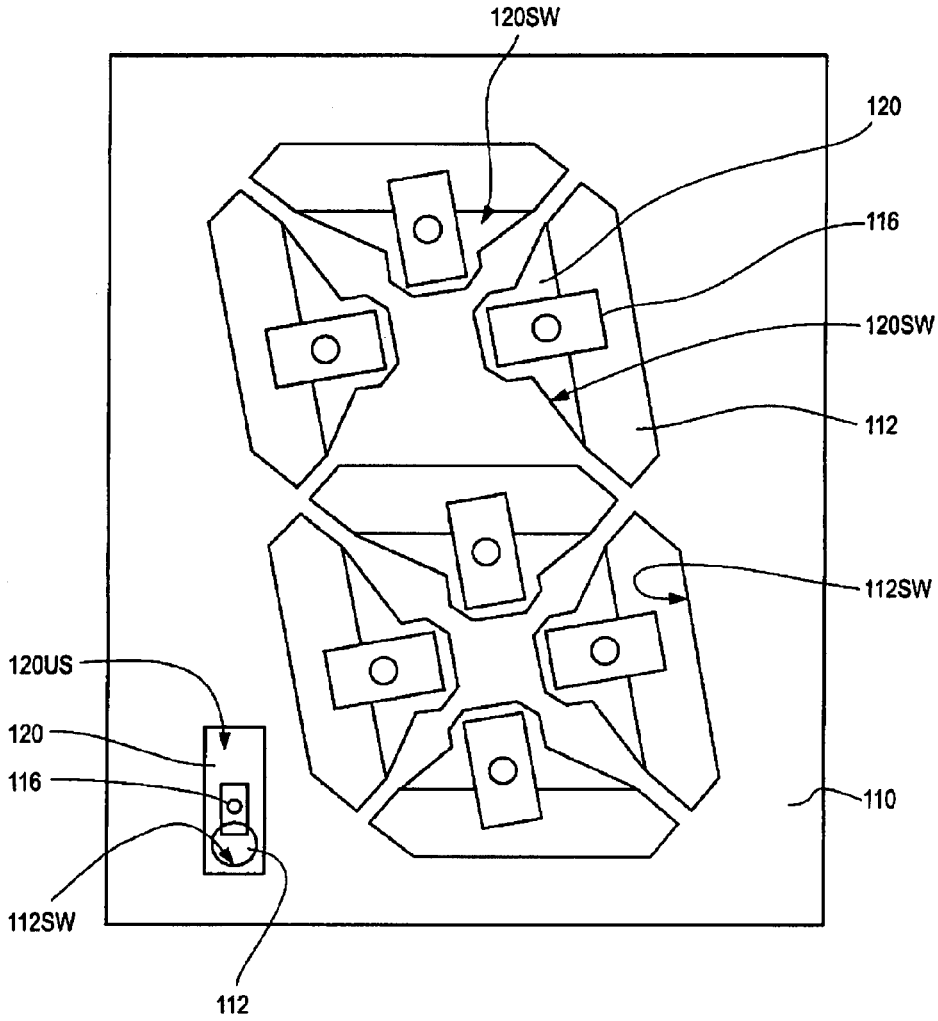
FIG. 7 is a partial rear plan view of the embodiment shown in FIG. 5.

FIGS. 5-7 illustrate an embodiment of a seven-segment display (plus decimal point) 100 having a relatively thin cross-section according to the present invention. The principles underlying this embodiment's design and construction can be applied to displays other than seven-segment displays, for example, simple indicator lights, as well, as would be recognized by one skilled in the art.

Display 100 includes substrate 110 having a number of penetrations 112 comprising the display's segments or elements. Each of penetrations 112 defines one or more side walls 112SW. Preferably, side walls 112SW are highly reflective as a function of the material of which substrate 110 is made, through application of a reflective coating to side walls 112SW, or otherwise, as would be recognized by one skilled in the art. Additionally and/or alternatively, each penetration 112 can be partially or completely filled with a light transmissive material, for example, a light transmissive epoxy, as discussed above. As another alternative, penetration 112 can be embodied as a light pipe within substrate 110. In further alternate embodiments, any or all of penetrations 112 can be embodied as cavities, as described above. A diffuser (not shown), for example, a diffuser similar to diffuser 30 as described in connection with FIG. 2, can be provided in connection with the user-viewable surface of substrate 110.

Preferably, a portion of substrate 110 adjacent each penetration 112 is undercut to form a relief 120. Relief 120 includes at least one sidewall 120SW and an upper surface 120US defined by substrate 110. Preferably, relief side wall (s) 120SW and relief upper surface 120US are highly reflective as a function of the material of which substrate 110 is made, through application of a reflective coating to relief side wall(s) 120SW and/or relief upper surface 120US, or otherwise, as would be recognized by one skilled in the art. Additionally and/or alternatively, each relief 120 can be partially or completely filled with a light transmissive material, for example, a light transmissive epoxy, as discussed above. Where used, such light transmissive material preferably is coextensive with any light transmissive material used in penetration 112, as discussed above, such that the light transmissive material forms a monolithic mass.

Substrate 110 overlies light source carrier 114, which can be a printed wiring board or other substrate. A light source 116 corresponding to each penetration 112 is mounted to light source carrier 114. In embodiments including relief 120, light source 116 can occupy at least a portion of the volume defined by relief 120 when light source carrier 114 and substrate 110 are joined. All or part of the surface of light source carrier 114 to which light source 116 is mounted can be reflective.

Preferably, each light source 116 is an LED, OLED, or PLED, although other light sources are suitable for use with the present invention as would be recognized by one skilled in the art. In alternate embodiments, light source carrier 114 can be omitted and light source 116 can be mounted directly to a rear portion of substrate 110. In such embodiments, a reflector (not shown) preferably is located in place of light source carrier 114 in order to better direct light emanating from light source 116 toward the interior of corresponding penetration 112. Other electrical/electronic components, for example, electrical traces and touch sensors, can be located on either or both of substrate 110 and light source carrier 114, as well.

Each light source 116 is offset from the center axis of its corresponding penetration 112. More preferably, as best illustrated in FIG. 6, each light source 116 is offset from its corresponding penetration 112 entirely. In such embodiments, substrate 110 preferably includes relief 120 and light source 116 is located in the volume defined by relief 120.

In use, light propagates indirectly from light source 116 through corresponding penetration 112 toward the exit opening of such penetration 112 by reflecting off of penetration side wall 112SW. In embodiments including relief 120, light propagates indirectly from light source 116 through corresponding penetration 112 toward the exit opening of such penetration 112 by reflecting off of one or more of relief side wall 120SW, relief upper surface 120US, and penetration side wall 112SW. (The light can reflect off of the adjacent surface of light source carrier 114, as well.)

In these foregoing embodiments, light propagates through penetration 112 over a greater distance than it would in an embodiment wherein light source 116 is aligned with penetration 112 and/or its center axis. These configurations provide for improved light diffusion through a penetration of a substrate of given thickness compared to a conventional display wherein light source 116 is aligned with corresponding penetration 112 or the center axis thereof. As such, for a given degree of light diffusion, these configurations allow for construction of a display having a thinner cross-section than such a conventional display. For example, the inventors have created a surface mountable display (embodying a relief, as described above) having an overall thickness, including substrate 110 and light carrier 114, of 2.61 mm, which is nearly 1 mm thinner than the thinnest conventional display the inventors are aware of.

FIGS. 8-12 illustrate a preferred embodiment of a display 200 having reconfigurable color output according to the present invention. The principles underlying this embodiment's design and construction can be applied to displays other than seven-segment displays, for example, simple indicator lights, as well, as would be recognized by one skilled in the art.

Display 200 includes a substrate 210 having a number of penetrations 212, each of which defines one or more side walls 212SW. Preferably, side walls 212SW are highly reflective as a function of the material of which substrate 210 is made, through application of a reflective coating to side walls 212SW, or otherwise, as would be recognized by one skilled in the art. Additionally and/or alternatively, each penetration 212 can be partially or completely filled with a light transmissive material, for example, a light transmissive epoxy 218. A diffuser (not shown), for example, a diffuser similar to diffuser 30 as described in connection with FIG. 2, can be provided in connection with the user-viewable surface of substrate 210. In alternate embodiments, any or all of penetrations 212 can be embodied as cavities, as described above.

Substrate 210 overlies light source carrier 214, which can be a printed wiring board or other substrate. A trio of light sources 216R,216G,216B corresponding to each penetration 212 is mounted to light source carrier 214. In alternate embodiments, light source carrier 214 can be omitted and light sources 216R,216G,216B can be mounted directly to a rear portion of substrate 210, as described above. In such embodiments, a reflector (not shown) preferably is provided in place of light source carrier 214 in order to better direct light emanating from light sources 216R,216G,216B toward the interior of corresponding penetration 212.

Preferably, each light source 216R,216G,216B is an LED, OLED, or PLED, although other light sources are suitable for use with the present invention as would be recognized by one skilled in the art. Light source 216R preferably emanates red light, light source 216G preferably emanates green light, and light source 216B preferably emanates blue light. Light sources 216R,216G,216B can be illuminated individually to yield red, green, or blue color output at the user-viewable surface of each penetration 212, i.e., each segment or element, of display 200. Alternatively, two or more of light sources 216R,216G,216B can be illuminated simultaneously to yield blended light of nearly any color at the user-viewable surface of each penetration 212 of display 200, i.e., each segment or element, of display 200. In other embodiments, more or fewer than three light sources can be provided in correspondence to each or any particular one of penetrations 212, and such light sources can be of colors other than red, green, and/or blue.

In the FIGS. 8-12 embodiment, each light source 216R, 216G,216B is aligned with its corresponding penetration 212. Optical performance of embodiments having light sources located in this manner can be improved by partially or completely filling penetrations 212 with light transmissive material, as discussed above, or by embodying penetrations 212 as cavities, both of which options tend to improve light diffusion and blending as light propagates from light sources 216R, 216G,216B toward the user-viewable surface of substrate 210.

In a first alternate embodiment, illustrated in FIGS. 13-17, each light source 216R,216G,216B is offset to one side of the center axis of its corresponding penetration 212. In such embodiment, each light source 216R,216G,216B preferably is offset to one side of its corresponding penetration 212 entirely. This configuration allows for a thinner cross-section than the configuration illustrated in and described in connection with FIGS. 8-12 by employing the optical principles described above in connection with the FIGS. 5-7 embodiment.

In a second alternative embodiment, illustrated in FIGS. 18-22, one of light sources 216R,216G,216B is offset to one side of the center axis of its corresponding penetration 212 and the other two of light sources 216R,216G,216B are offset to the other side of the center axis of such penetration. Preferably, the light sources are offset from the respective sides of such penetration entirely. This configuration allows for a thinner cross-section than the configuration illustrated in and described in connection with FIGS. 8-12 by employing the optical principles described above in connection with the FIGS. 5-7 embodiment. This configuration also can yield a smaller overall package by making better use of available space on light source carrier 214 and/or substrate 210 to either side of penetrations 212 for mounting light sources 216R/ 216G/216B.

The present invention is limited only by the following claims and not the foregoing embodiments. One skilled in the art would know to make certain modifications to the foregoing embodiments without departing from the scope of the claims. Elements of a given embodiment described herein generally can be substituted for and/or combined with elements of other embodiments, as would be recognized by one skilled in the art.

The invention claimed is:

1. A display apparatus comprising:

a first substrate having a first side and a second side;

said first substrate defining a first optical path extending from said first side of said first substrate to said second side of said first substrate; and a first light source mounted directly to a portion of said first substrate opposite said second side of said first substrate and laterally offset from said first optical path such that light emitted by said first light source propagates from said first light source to said second side of said substrate via said first optical path only indirectly.

2. The apparatus of claim 1 further comprising a second substrate associated with said first side of said first substrate.

3. The apparatus of claim 2 wherein said second substrate is integrated with said first substrate in a substantially parallel relationship.

4. The apparatus of claim 1 wherein said first optical path comprises a first aperture in said first substrate.

5. The apparatus of claim 1 wherein said first optical path comprises an optically transmissive medium.

6. The apparatus of claim 1, said first substrate further defining one or more additional optical paths extending from said first side of said first substrate to said second side of said first substrate; and one or more additional light sources, each of said one or more additional light sources corresponding to respective ones of said one or more additional optical paths, each of said one or more additional light sources mounted directly to a respective portion of said first substrate opposite said second side of said first substrate and laterally offset from its respective optical path such that light emitted by a specific one of said one or more additional light sources is visible from said second side of said first substrate by way of the respective optical path and such that said light emitted by said specific one of said one or more additional light sources propagates from said specific one of said one or more additional light sources to said second side of said first substrate via the respective optical path only indirectly.

7. The apparatus of claim 6 wherein light emitted by any specific one of said light sources does not propagate through any of said optical pats except the optical path corresponding to said specific light source.

8. The apparatus of claim 6 wherein said display apparatus comprises a seven-segment display.

9. The apparatus of claim 1 wherein said first light source comprises a light emitting point source.

10. The apparatus of claim 1 wherein said first light source comprises a light emitting material.

11. A display apparatus comprising:

a first substrate having a first side and a second side;

said first substrate defining a first optical path extending from said first side of said substrate to said second side of said substrate, said first optical path comprising a cavity having an open end and a closed end, said cavity extending inwardly into said first substrate from said first side of said substrate toward said second side of said substrate, and a portion of said substrate between said closed end of said cavity and said second side of said first substrate;

a first light source associated with said first side of said first substrate such that light emitted by said first light source is visible from said second side of said first substrate and such that said light emitted by said first light source propagates from said light source to said second side of said first substrate via said first optical path only indirectly.

12. A display apparatus comprising:

a first substrate having a first side and a second side;

said first substrate comprising a first optical path extending from said first side of said first sub skate to said second side of said first substrate; and a first plurality of light sources mounted directly to a portion of said first substrate opposite said second side of said first substrate and laterally offset from said first optical path such that light emitted from a first of said first plurality of light sources blends with light emitted from a second of said first plurality of light sources and such that the blended light propagates to said second side of said substrate via said first optical path only indirectly.

13. The apparatus of claim 12 wherein said light emitted from each of said first of said first plurality of light sources and said second of said first plurality of light sources propagates to said second side of said substrate through said first optical path only as a constituent element of the blended light.

14. The apparatus of claim 12 wherein light emitted from a third of said plurality of light sources blends with light emitted from each of said first and said second of said first plurality of light sources and wherein the blended light propagates to said second side of said substrate via said first optical path.

15. The apparatus of claim 14 wherein said light emitted from each of said first of said first plurality of light sources, said second of said first plurality of light sources, and a third of said first plurality of light sources propagates to said second side of said substrate through said first optical path only as a constituent element of the blended light.

16. The apparatus of claim 12 wherein said light emitted by said first plurality of light sources is blended within said first optical path.

17. The apparatus of claim 12 wherein said first optical path comprises an optically transmissive material.

18. The apparatus of claim 12 wherein said first optical path comprises a cavity defined by said first substrate.

19. The apparatus of claim 12 wherein said first optical path comprises a penetration defined by said first substrate.

20. The apparatus of claim 12 wherein a first of said plurality of light sources emits light of a first color and a second of said first plurality of light sources emits light of a second color.

21. The apparatus of claim 20 wherein a third of said first plurality of light sources emits light of a third color.

22. The apparatus of claim 12, said first substrate further comprising:

one or more additional optical paths extending from said first side of first substrate to said second side of said first substrate; and one or more additional pluralities of light sources, each of said one or more additional pluralities of light sources corresponding to a respective one of said one or more additional optical paths, each of said one or more additional pluralities of light sources mounted directly to a respective portion of said first substrate opposite said second side of said first substrate and laterally offset from its respective optical path, such that light emitted from a first light source of a specific one of said one or more additional pluralities of light sources blends with light emitted from at least one other light source of said specific one of said one or more additional pluralities of light sources and such that said blended light propagates to said second side of said substrate via its respective optical path only indirectly.

23. The apparatus of claim 1 wherein said first substrate defines a relief and wherein said first light source is contained within the volume defined by said relief.

24. The apparatus of claim 2 wherein said second substrate comprises a reflector, wherein said reflector reflects at least a portion of said light emanating from said first light source toward said first optical path.

* * * * *

UNITED STATES PATENT AND TRADEMARK OFFICE

CERTIFICATE OF CORRECTION

Figure 8:
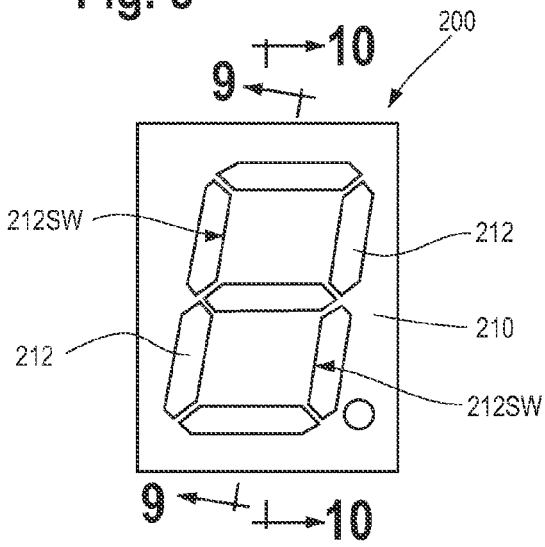
FIG. 8 is a plan view of the viewable surface of a display according to the present invention.
Figure 9:
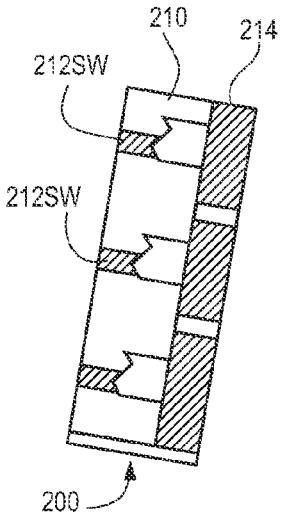
FIG. 9 is a cross-section of the display of FIG. 8 taken across line 9-9.
Figure 10:
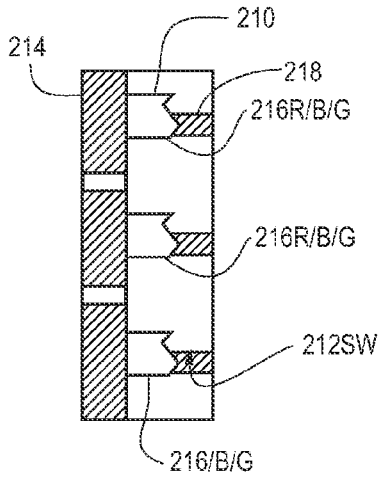
FIG. 10 is a cross-section of the display of FIG. 8 taken across line 10-10.
Figure 11:
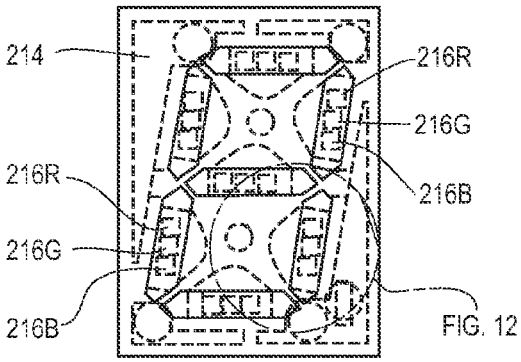
FIG. 11 is plan view of a light source carrier for use with the display of FIG. 8.
Figure 12:
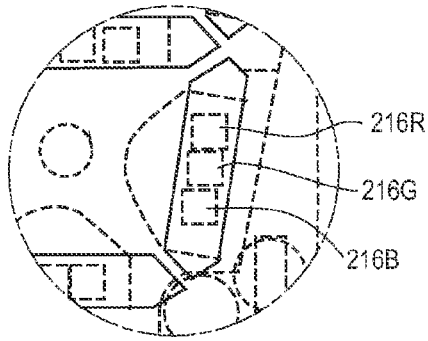
FIG. 12 is a detail view of a portion of the light source carrier of FIG. 11.
Figure 13:
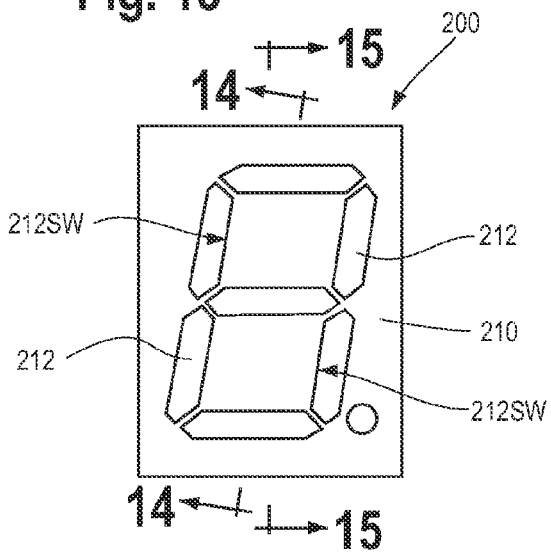
FIG. 13 is a plan view of the viewable surface of an alternate embodiment of a display according to the present invention.
Figure 14:
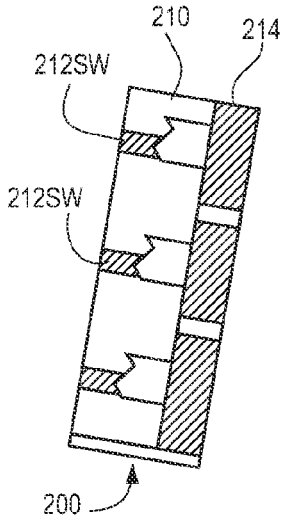
FIG. 14 is a cross-section of the display of FIG. 13 taken across line 14-14.
Figure 15:
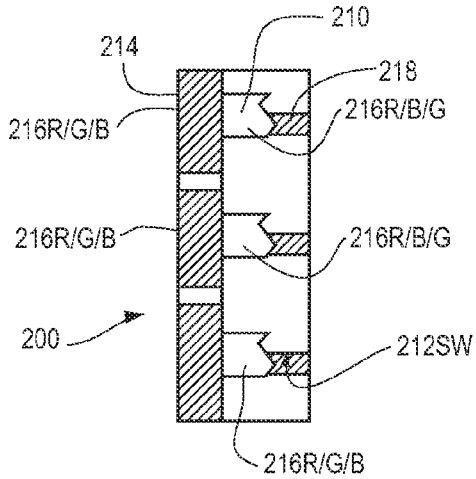
FIG. 15 is a cross-section of the display of FIG. 8 taken across line 15-15.
Figure 16:
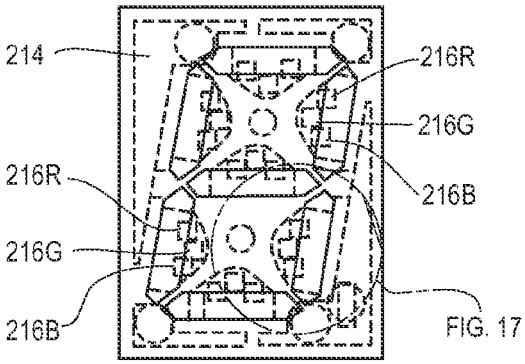
FIG. 16 is plan view of a light source carrier for use with the display of FIG. 13.
Figure 17:
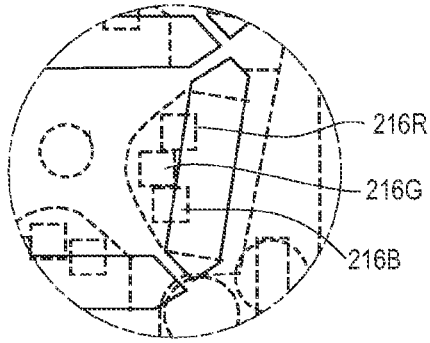
FIG. 17 is a detail view of a portion of the light source carrier of FIG. 16.
Figure 18:
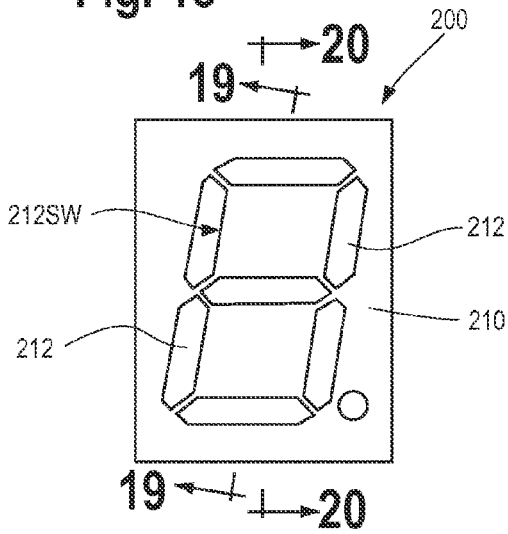
FIG. 18 is a plan view of the viewable surface of another alternate embodiment of a display according to the present invention.
Figure 19:
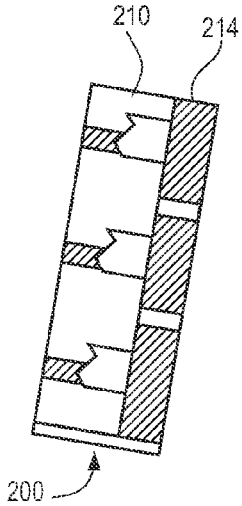
FIG. 19 is a cross-section of the display of FIG. 18 taken across line 19-19.
Figure 20:
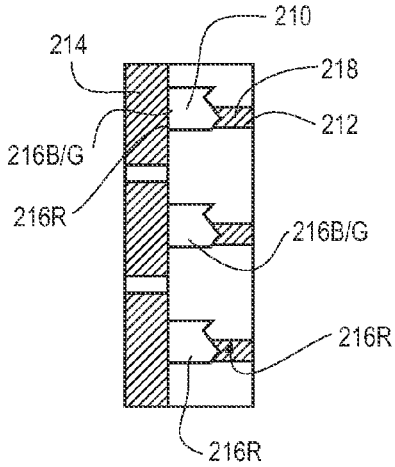
FIG. 20 is a cross-section of the display of FIG. 8 taken across line 20-20.
Figure 21:
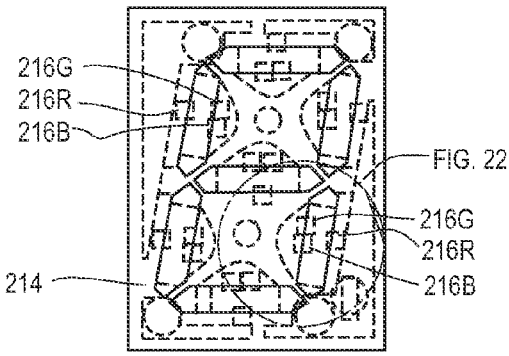
FIG. 21 is plan view of a light source carrier for use with the display of FIG. 18.
Figure 22:
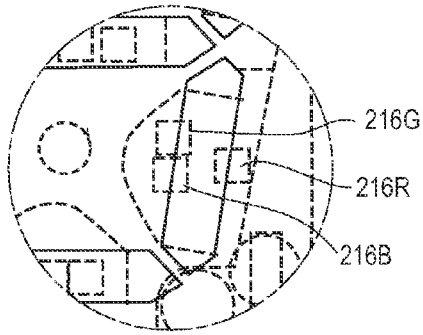
FIG. 22 is a detail view of a portion of the light source carrier of FIG. 21.

PATENT NO. : 7,850,339 B2
APPLICATION NO. : 11/705232
DATED : December 14, 2010
INVENTOR(S) : Bahar N. Wadia and Donald Charles Mueller It is certified that error appears in the above-identified patent and that said Letters Patent is hereby corrected as shown below:

col. 4, line 37, delete "FIG. 8" and insert in its place --FIG. 13--.

claim 7 as follows:

col. 10, line 34, delete "pats" and insert in its place --paths--.

claim 12 as follows:

col. 10, line 63, delete "sub skate" and insert in its place --substrate--.

Signed and Sealed this
Twenty-sixth Day of April, 2011

David J. Kappos

David J. Kappos
*Director of the United States Patent and Trademark Office*